US010438766B2

(12) United States Patent
Issbruecker et al.

(10) Patent No.: US 10,438,766 B2
(45) Date of Patent: Oct. 8, 2019

(54) X-RAY EMITTER

(71) Applicant: SIEMENS HEALTHCARE GMBH, Erlangen (DE)

(72) Inventors: Carry Issbruecker, Saalfeld (DE); Robert Standar, Pretzfeld (DE)

(73) Assignee: Siemens Healthcare GmbH, Erlangen (DE)

( * ) Notice: Subject to any disclaimer, the term of this patent is extended or adjusted under 35 U.S.C. 154(b) by 238 days.

(21) Appl. No.: 15/656,320

(22) Filed: Jul. 21, 2017

(65) Prior Publication Data

US 2018/0025883 A1 Jan. 25, 2018

(30) Foreign Application Priority Data

Jul. 21, 2016 (DE) ..... 10 2016 213 336

(51) Int. Cl.

| | |
|---|---|
| ***H01J 35/06*** | (2006.01) |
| ***H05G 1/04*** | (2006.01) |
| ***H01J 35/10*** | (2006.01) |
| ***H01J 35/18*** | (2006.01) |

(52) U.S. Cl.

CPC ..... *H01J 35/06* (2013.01); *H01J 35/101* (2013.01); *H01J 35/18* (2013.01); *H05G 1/04* (2013.01); *H01J 2235/1046* (2013.01)

(58) Field of Classification Search

CPC ..... H01J 35/06; H01J 35/101; H01J 35/18; H01J 2235/1046; H05G 1/04

See application file for complete search history.

(56) References Cited

U.S. PATENT DOCUMENTS 4,433,432 A * 2/1984 Nii ..... H01J 35/16 378/193
5,696,808 A * 12/1997 Lenz ..... H01J 35/101 378/101
2003/0025582 A1 2/2003 Arz et al.

FOREIGN PATENT DOCUMENTS

| | | |
|---|---|---|
| CN | 1399141 A | 2/2003 |
| DE | 19716723 A1 | 11/1998 |
| DE | 102004035981 B4 | 7/2007 |

* cited by examiner

*Primary Examiner* — David P Porta
*Assistant Examiner* — Fani Boosalis
(74) *Attorney, Agent, or Firm* — Laurence Greenberg Werner Stemer; Ralph Locher

(57) ABSTRACT

An X-ray emitter includes an emitter housing in which an X-ray tube is disposed and held in the emitter housing by a fixing facility. The fixing facility includes a fixed bearing disposed on the cathode side and a floating bearing disposed on the anode side. At least the floating bearing has at least one damping element. In the X-ray emitter, the X-ray tube is aligned inside the emitter housing and fixed in a respectively low-vibration or vibration-damped manner, resulting in a more stable focus position relative to a beam exit and also a correspondingly improved image quality.

10 Claims, 1 Drawing Sheet

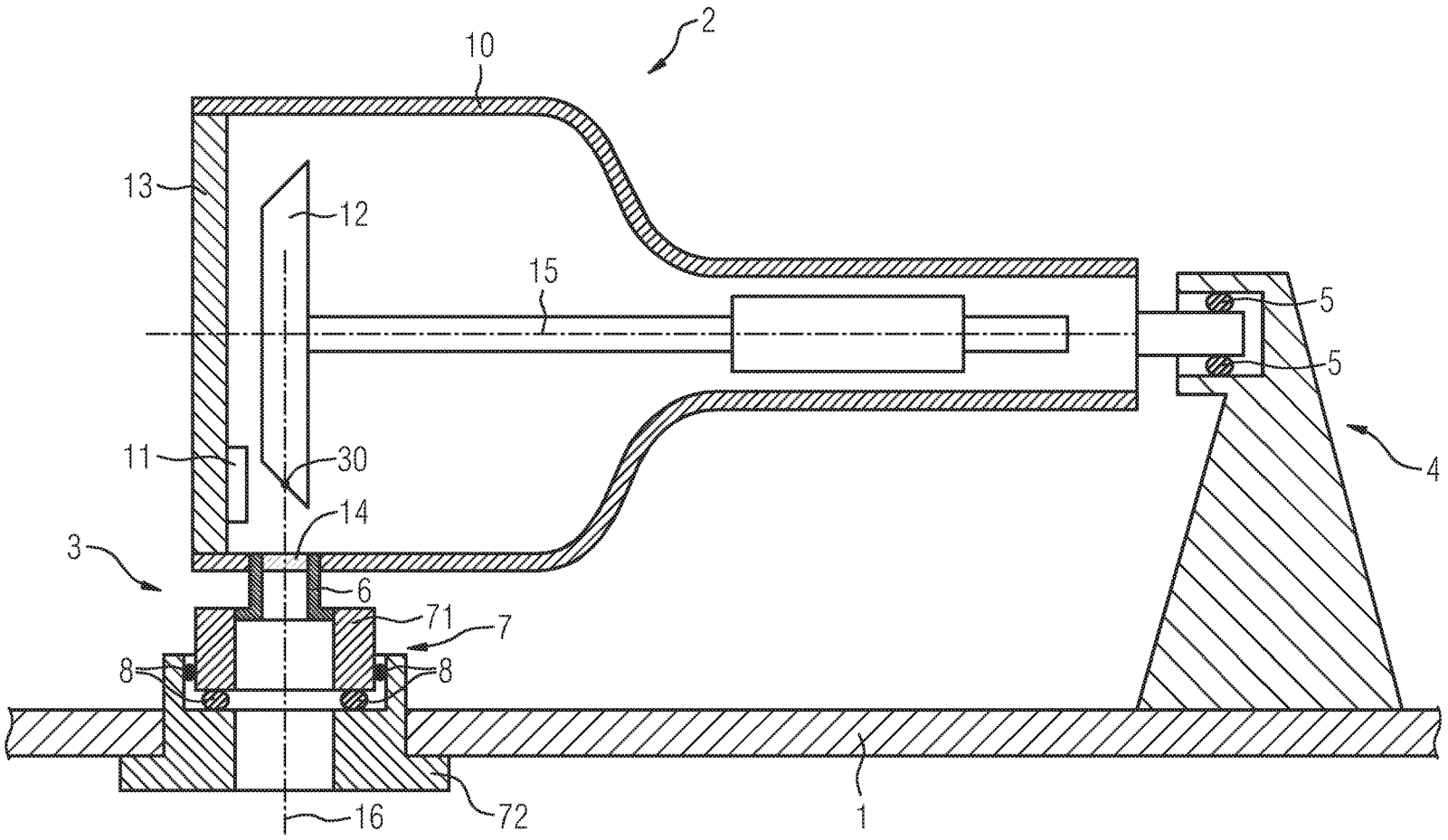
4
5
5
2
10
15
12
30
14
6
71
7
8
72
16
1
13
11
3
8

X-RAY EMITTER

CROSS-REFERENCE TO RELATED APPLICATION

This application claims the priority, under 35 U.S.C. § 119, of German Patent Application DE 10 2016 213 336.5, filed Jul. 21, 2016; the prior application is herewith incorporated by reference in its entirety.

BACKGROUND OF THE INVENTION

Field of the Invention

The invention relates to an X-ray emitter.

An X-ray emitter of this type includes an emitter housing in which an X-ray tube is disposed. The X-ray tube is held in the emitter housing by way of a fixing facility.

The X-ray tube includes a vacuum housing in which a cathode and an anode are disposed. The cathode emits electrons which are accelerated in the direction of the anode and generate X-ray radiation upon impacting in a focal spot in the material of the anode. The focal spot can be either stationary (standing/fixed anodes) or form a focal track (rotating anodes in the case of rotating anode X-ray tubes or rotating cylinder X-ray tubes). The X-ray radiation being generated exits from the vacuum housing as useful X-ray radiation through a beam exit window in the form of a beam of rays. The X-ray beam running from the mid-point of the focal spot perpendicular to the tube axis and in the center of the useful beam of rays is referred to as the central beam in this regard.

The vacuum housing is produced completely out of glass (glass tube), completely out of metal (all-metal tube), out of a combination of metal and glass (metal center section tube), or out of a combination of metal and ceramic (metal ceramic tube).

In the known devices, the metal center section tube or the all-metal tube is connected to the bearing stub of the X-ray tube in a form-locking or force-locking manner with the aid of a tube holder. That anode-side fixing by using a fixed bearing is implemented for example by using bolt fixings or bayonet locks. Due to the long lever arm (spacing between the central beam of the X-ray tube and its fixing in the emitter housing), the X-ray tube (vacuum housing) has to be adjusted on the anode side in order to align the X-ray tube on the tube flange with respect to the beam exit window of the emitter housing. On the cathode side (that is to say close to the focus), the X-ray tube is just supported by using a floating bearing in order to fix the position of the tube flange (and therefore the position of the central beam and focal spot) relative to the emitter housing.

In the case of the known X-ray emitter, vibrations generated by the bearing system of the anode or by the unavoidable residual unbalance of the anode can be transmitted directly in to the emitter housing. Vibrations from a gantry of a computer tomography machine can also be transmitted to the emitter housing and therefore to the X-ray tube.

SUMMARY OF THE INVENTION

It is accordingly an object of the invention to provide an X-ray emitter, which overcomes the hereinafore-mentioned disadvantages of the heretofore-known devices of this general type and which provides an aligned and low-vibration or vibration-damped fixing for an X-ray tube inside an emitter housing.

With the foregoing and other objects in view there is provided, in accordance with the invention, an X-ray emitter, comprising an emitter housing, in which an X-ray tube is disposed and held in the emitter housing by way of a fixing facility. The fixing facility includes a fixed bearing disposed on the cathode side and a floating bearing disposed on the anode side, and at least the floating bearing has at least one damping element.

Therefore, once again, in the invention, a fixed bearing/floating bearing configuration is implemented, with the cathode-side fixed bearing only absorbing the axial forces and the anode-side floating bearing permitting an axial displacement.

In the case of the X-ray emitter of the invention, the X-ray tube is supported on the anode side in a floating bearing which has at least one damping element. As a result of the floating bearing the thermal linear expansions arising in the operating state of the X-ray tube are absorbed. Furthermore, the vibrations of the X-ray tube arising in some circumstances during operation are absorbed and therefore no longer transmitted directly to the emitter housing. At the same time the damping element in the floating bearing provides radial support to the X-ray tube. As a result of the anode-side floating bearing the (axial) linear expansion of the X-ray tube no longer influences the position of the central beam emerging from the beam exit window of the X-ray tube relative to the beam exit window of the emitter housing. Instead the linear expansion of the X-ray tube is displaced to a range in which it has no technical or functional influence.

The invention is suitable for all kinds of X-ray tubes with flanges and can therefore be employed both in an X-ray emitter with a rotating anode X-ray tube and also in an X-ray emitter with a rotating cylinder X-ray tube. The invention can also be implemented without difficulty in the case of an X-ray emitter with a fixed anode.

In accordance with an advantageous embodiment variant, the fixed bearing has at least one damping element. Both the floating bearing and also the fixed bearing are therefore equipped with at least one damping element. As a result, the damping of the X-ray tube in the emitter housing is again improved during the operation of the X-ray emitter.

In the context of the invention, the X-ray tube is implemented in the form of an all-metal tube or in the form of a metal center section tube or in the form of a metal ceramic tube.

In a preferred embodiment variant of the X-ray emitter, the emitter housing is constructed in the form of an X-ray emitter housing. The emitter housing therefore substantially contains only the X-ray tube.

In accordance with a similarly advantageous embodiment of the X-ray emitter, the emitter housing is implemented in the form of a single-tank housing. In the single-tank housing, the X-ray tube and the associated high-voltage unit (high-voltage generator) are disposed together. The single-tank housing therefore similarly forms an emitter housing.

In a further advantageous exemplary embodiment of the X-ray emitter, the emitter housing is configured in the form of a duo-block. The X-ray tube and the heating transformer are disposed in the duo-block whereas the high-voltage generator is mounted separately and does not form part of the duo-block.

In a particularly advantageous embodiment variant of the inventive X-ray emitter, the fixed bearing includes a tube flange and a fixing flange, wherein the tube flange is fixed rigidly to the tube housing and the fixing flange is implemented as part of the emitter housing. In this preferred embodiment, the fixing of the X-ray tube is therefore effected inside the emitter housing close to the focus directly on the tube flange (fixed bearing). The metal center section and all-metal tubes are fixed directly in the emitter housing, in the single-tank housing, or in the duo-block in a form-locking, force-locking, or material-bonded manner. An adjustment of the X-ray tube with respect to the emitter housing is therefore no longer required. The precondition for this is that the tube flange is already adjusted with respect to the central beam of the X-ray tube.

A further preferred embodiment of the X-ray emitter, which involves a particularly advantageous embodiment variant, is distinguished in that the tube flange encloses a beam exit window disposed in the X-ray tube on an outer periphery.

The invention and its advantageous embodiment variants offer the following advantages as compared with the X-ray emitters known to date:

- During operation of the X-ray emitter, substantially smaller influences of thermal linear expansions of the anode configuration (rotating anode with anode shaft) and the tube housing occur. As a result of the inventive measure, specifically to provide an anode-side floating bearing, the linear expansion of the X-ray housing no longer has virtually any influence on the position of the central beam (focus position).
- Due to the cathode-side fixed bearing provided by the invention, a substantially more stable position of the focus points (fixed-bearing mounting close to the focus) and therefore an improvement in the image quality is obtained in the operation of the inventive X-ray emitter.
- As a result of at least one damping element in the floating bearing, vibrations which can arise by using the anode configuration in the operating state are compensated for. Vibrations are therefore no longer brought directly into the emitter housing. The X-ray emitter therefore runs substantially with less vibration in operation so that a correspondingly lower noise level arises. This noise reduction is perceived as more pleasant by patients and operators. This results in a lowering of the risk of failed photographs due to patient movements which are possibly caused by patients in the presence of a suddenly occurring unfamiliar noise.
- The floating bearing is just used for supporting the X-ray tube but permits a movement in the longitudinal direction. Therefore, in the floating bearing, a linear expansion of the X-ray tube due to the temperature arising in operation is compensated for. As a result a displacement of the central beam in the beam exit window of the emitter housing is reliably prevented.
- Since the tube flange is already adjusted with respect to the central beam of the X-ray tube, the adjustment of the X-ray tube in the emitter housing which was previously necessary ceases to apply.
- If not only the floating bearing but also the fixed bearing is provided with damping elements, the respective vibration damping or vibration decoupling and therefore a corresponding noise reduction is again improved. At the same time the damping elements serve the purpose of electrical isolation with respect to the respective emitter housing or single-tank housing. In this regard the damping elements have a hardness of e.g. greater than 80 Shore A.

Other features which are considered as characteristic for the invention are set forth in the appended claims.

Although the invention is illustrated and described herein as embodied in an X-ray emitter, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

The FIGURE of the drawing is a diagrammatic, partial longitudinal-sectional view of an exemplary embodiment of an X-ray emitter according to the invention.

DETAILED DESCRIPTION OF THE INVENTION

Referring now in detail to the single FIGURE of the drawing, there is seen a representation of an X-ray emitter to which, however, the invention is not restricted. The X-ray emitter includes an emitter housing 1 in which an X-ray tube 2 is disposed.

The X-ray tube 2 is realized in the form of a metal center section tube and includes a vacuum housing 10 in which a cathode 11 and an anode 12 are disposed. The vacuum housing 10 is vacuum-tightly sealed by using a cathode cover 13. The cathode 11 emits electrons which are accelerated in the direction of the anode 12 and generate X-ray radiation upon impacting in a focal spot 30 in the material of the anode 12. The anode 12 is implemented in the form of a rotating anode so that the focal spot 30 forms a focal track. The X-ray radiation being generated emerges from the vacuum housing 10 through a beam exit window 14 as useful X-ray radiation in the form of a beam of rays. The X-ray beam running from the mid-point of the focal spot 30 perpendicular to a tube axis 15 and in the center of the useful beam of rays is referred to as a central beam 16 in this regard.

The X-ray tube 2 is held in the emitter housing 1 by way of a fixing facility. According to the invention, the fixing facility includes a fixed bearing 3 disposed on the cathode side and a floating bearing 4 on the anode side. In the exemplary embodiment represented in the FIGURE, the floating bearing 4 has a damping element 5. In the context of the invention, however, a plurality of damping elements is also possible.

In the case of the single exemplary embodiment, the fixed bearing 3 includes a tube flange 6 which is fixed rigidly to the vacuum housing 10 of the X-ray tube 2. Furthermore, the fixed bearing 3 includes a two-part fixing flange 7 having a first part 71 and a second part 72. The first part 71 of the fixing flange 7 is connected to the tube flange 6 in a torsion-resistant manner following the installation of the X-ray tube 2 in the emitter housing 1. The second part 72 of the fixing flange 7 is connected to the emitter housing 1. The fixing flange 7 is implemented as part of the emitter housing 1 and is fixed with the second part 72 in the emitter housing 1 to this effect.

The tube flange 6 encloses the external periphery of the beam exit window 14 disposed in the X-ray tube 2. The exit of the useful X-ray radiation out of the beam exit window 14 is therefore not impeded. Furthermore, the fixing flange 7 keeps the region of the beam exit window 14 free from cooling insulation medium.

Furthermore, the fixed bearing 3 has damping elements 8 which are disposed between the first part 71 and the second part 72 of the fixing flange 7 in the exemplary embodiment represented in the FIGURE.

The fixing of the X-ray tube 2 is effected inside the emitter housing 1 close to the focus by way of the tube flange 6 directly on the fixing flange 7, which is implemented as part of the emitter housing 1. In the case of the exemplary embodiment represented in the drawing, the vacuum housing 10 of the X-ray tube 2 is fixed directly on the emitter housing 1 by using fixing bore holes in the fixing flange 7. An adjustment of the vacuum housing 10 with respect to the emitter housing 1 is therefore no longer required. For this purpose, the tube flange 6 must already be adjusted with respect to the central beam 16 of the X-ray tube 2.

Although the invention has been precisely illustrated and described in detail by the preferred exemplary embodiment, the invention is not restricted by the disclosed exemplary embodiment and other variants can be derived from the same by a person skilled in the art without departing from the scope of protection of the invention.

As explained above, the invention relates to an X-ray emitter with an emitter housing 1, in which an X-ray tube 2 is disposed and held in the emitter housing 1 by way of a fixing facility. According to the invention, the fixing facility includes a fixed bearing 3 disposed on the cathode side and a floating bearing 4 on the anode side, wherein at least the floating bearing 4 has at least one damping element 5. As explained in the description on the basis of the exemplary embodiment represented in the FIGURE, the X-ray tube 2 is aligned inside the emitter housing 1 and fixed in a respectively low-vibration or vibration-damped manner in an X-ray emitter of this type.

In the case of the X-ray emitter according to the invention, a low-vibration fixing of the X-ray tube 2 in the emitter housing 1 is obtained by using the fixed bearing 3 close to the focus. As a result, operating noises occurring are greatly reduced. Moreover, a substantially more stable focus position relative to the beam exit window 14 is achieved by using the device of the invention, resulting in a correspondingly improved image quality being produced.

The invention claimed is:

1. An X-ray emitter, comprising:

an emitter housing;

an X-ray tube disposed in said emitter housing, said X-ray tube including a vacuum housing;

a fixing facility holding said X-ray tube in said emitter housing;

said fixing facility including a fixed bearing disposed on a cathode side and a floating bearing disposed on an anode side; and at least said floating bearing having at least one damping element.

2. The X-ray emitter according to claim 1, wherein said fixed bearing has at least one damping element.

3. The X-ray emitter according to claim 1, wherein said X-ray tube is an all-metal tube.

4. The X-ray emitter according to claim 1, wherein said X-ray tube is a metal center section tube.

5. The X-ray emitter according to claim 1, wherein said X-ray tube is a metal ceramic tube.

6. The X-ray emitter according to claim 1, wherein said emitter housing is an X-ray emitter housing.

7. The X-ray emitter according to claim 1, wherein said emitter housing is a single-tank housing.

8. The X-ray emitter according to claim 1, wherein said emitter housing is a duo-block.

9. The X-ray emitter according to claim 1, wherein said fixed bearing includes a tube flange and a fixing flange, said tube flange is fixed rigidly to said X-ray tube and said fixing flange is part of said emitter housing.

10. The X-ray emitter according to claim 9, wherein said tube flange encloses an outer periphery of a beam exit window disposed in said X-ray tube.

* * * * *